US005375487A

United States Patent [19]

Zimmerman

[11] Patent Number: 5,375,487

[45] Date of Patent: Dec. 27, 1994

[54] MAUL HEAD PARTIALLY FILLED WITH SHOT

[75] Inventor: R. Charles Zimmerman, Cincinnati, Ohio

[73] Assignee: Zimmerman Packing & Mfg., Inc., Cincinnati, Ohio

[21] Appl. No.: 136,369

[22] Filed: Oct. 15, 1993

[51] Int. Cl.[5] ..... B25D 1/12

[52] U.S. Cl. ..... 81/22; 81/19; 81/26

[58] Field of Search ..... 81/19, 20, 22, 26

[56] References Cited

U.S. PATENT DOCUMENTS 642,755 2/1900 Prouty .
763,553 6/1904 Goddard .
912,784 2/1909 Bayley .
1,723,477 8/1929 Farrar .
2,604,914 7/1952 Kahlen .
3,088,506 5/1963 Bianchini .
3,343,576 9/1967 Norcross .
4,039,012 8/1977 Cook .

OTHER PUBLICATIONS

"Spearhead" Zimmerman Packing & Mfg., Inc. 1 page brochure, 1992.

*Primary Examiner*—James G. Smith
*Attorney, Agent, or Firm*—Steven J. Rosen

[57] ABSTRACT

A maul assembly including a maul head having an annular body with an annular outer wall concentric to an annular inner wall and an annular chamber within the body disposed between the two walls. The annular walls and chamber are circumferentially disposed about a head center axis which is coincidental with a handle center axis of a handle attached to an end of the head. The chamber is partially filled with a quantity of flowable inertia material preferably round steel shot and preferably in a range of about 50% to 75% of the chamber's volume and preferably with steel shot.

19 Claims, 1 Drawing Sheet

MAUL HEAD PARTIALLY FILLED WITH SHOT

BACKGROUND OF THE INVENTION

1. Field of the Invention

The present invention relates generally to mauls and, more specifically, to a maul with a maul head having an annular chamber with a portion of its volume filled with shot.

2. Description of Related Art

Hammers and mauls have conventionally been used for striking objects to drive them. Hammers are conventionally used in conjunction with punches to, among other applications, cut various suitable materials to form gaskets. A particular problem with conventional hammers and mauls is that they tend to roll and become useable when striking the top of a small surface such as the strike surface of a punch apparatus. The problem is more acute when the line of force of the hammer or maul head is not perfectly aligned with the center of the strike surface.

Such mauls and hammers are subject to moments about the axis of the head and/or handle which reduces the stability of the head thus requiring more hand and arm strength to be exerted to hold the hammer. The need for additional hand and arm strength prevents the user from using more power thus causing more hits to be required in order to drive the punch through the material. Mauls and hammers typically impact the top of punches off their centers which causes the punch to tilt sideways thus producing an uneven hit and causing the user to refrain from using maximum power because he may hit himself. Such a problem is encountered when using a hammer or maul on a punch to form gaskets from material.

Hammers generally have an annular or cylindrical heads with a centerline axis that is perpendicular to a centerline axis of a handle whereas mauls generally have an annular or cylindrical heads with a centerline axis that is collinear with a centerline axis of a handle. Hammer heads have been developed to prevent rebound such as the one disclosed in U.S. Pat. No. 2,604,914. A hammer head having a hollow chamber partially filled with a quantity of flowable inertia material such as shot to give the head its dead-blow characteristics. Whereas these hammers have uninterrupted cylindrical chambers directly behind flat circular strike surfaces prior art mauls do not. Mauls have no flat strike surface and no hollow chambers. Cylindrical hammer heads have center axes that are generally at right angles to their handles while maul head's center axes are generally collinear with and disposed about a central shaft used for the handle. Furthermore, the forces associated with a maul tend to cause the outer strike surface to go flat and collapse the head thereby giving good reason not to have hollow maul heads.

Maul heads are generally cylindrical in shape having a solid body such as in U.S. Pat. No. 912,784 which uses disks held between washers to form a solid maul head. Solid maul heads are often made as assemblies such as the ones disclosed in U.S. Pat. Nos. 1,723,477 and 3,088,506. Because of the way mauls are used the heads are typically generally symmetrical about a center axis which causes mauls to roll away from the user and even off a bench, particularly on ones that are not very level.

Therefore, there exists a great need for a maul design to reduce a maul's tendency to roll and become useable when striking a top of a small surface such as a strike surface of a punch. There further exists a need to reduce and/or eliminate moments about the axis of a maul head and/or handle which reduces the stability of the head which would then require less hand and arm strength to be exerted to hold the maul and prevent it from causing the punch to tilt sideways during the hitting process. There also exists a need for a maul which allows a user to use more power than during the hitting process than is presently used with conventional mauls and hammers. There is also a need for a maul which when used with punch will make the user less apprehensive and more comfortable exerting greater power thus allowing the user to safely maximize the amount power he uses to drive the punch through the material. There exists a need for a maul to avoid such a problems when using a maul on a punch to form gaskets from material so as to allow the user to work faster and safer by reducing and/or preventing this sideways tiling of the punch when on material to form a gasket.

SUMMARY OF THE INVENTION

The present invention provides a maul head with an annular body having an annular chamber within and that is partially filled with a quantity of flowable inertia material. One embodiment of the present invention provides a maul assembly including a maul head having an annular body with an annular outer wall concentric to an annular inner wall and an annular chamber within the body disposed between the two walls. The annular walls and chamber are circumferentially disposed about a head center axis which is coincidental with a handle center axis of a handle attached to an end of the head. The chamber is partially filled with a quantity of flowable inertia material preferably round steel shot and preferably to about 50% of the chamber's volume and preferably with steel shot.

Another particular embodiment provides a cylindrical rod preferably solid and made of steel having a center axis and an annular maul head circumferentially disposed about one end of the rod. The head includes a hard preferably steel annular outer wall having a first length and a hard preferably steel annular inner wall disposed about the rod having a second length that is shorter than the first length. Ends of the chamber are formed by two end walls are disposed within and at opposite ends of the outer wall having central circular holes through which the rod is disposed and the end walls abut opposite ends of the inner wall. Securing means to hold the assembly together is provided preferably in the form of welded seams between the end walls and the rod and an interference fit such as in the form of a swaged seam between the end walls and the outer wall. An alternate securing means provides for welded seams between the end walls and the outer wall. A molded plastic cover surrounds the head and a portion of the rod extending from the head to form the handle attached to the head.

ADVANTAGES

A principal advantage of the present invention is the ability to reduce or essentially eliminate moments about the center axis of a maul when the maul is used to strike an object. This helps stabilize the head during striking which then require less hand and arm strength to be exerted to hold the maul. When used with a punch a maul in accordance with the present invention prevents the punch from moving sideways during striking. Another advantage is had when a maul and punch of the present invention are used to form gaskets from material because the present invention helps prevent sideways tilting of the punch and allows the operator to use more power to drive the punch faster than with conventional mauls and hammers. Another advantage is that the maul when set down on its annular side, as often done by users, does not easily roll even if the surface upon which it is set is at a slight angle as is often the case with shop tables.

The foregoing, and other features and advantages of the present invention, will become more apparent in the light of the following description and accompanying drawing.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
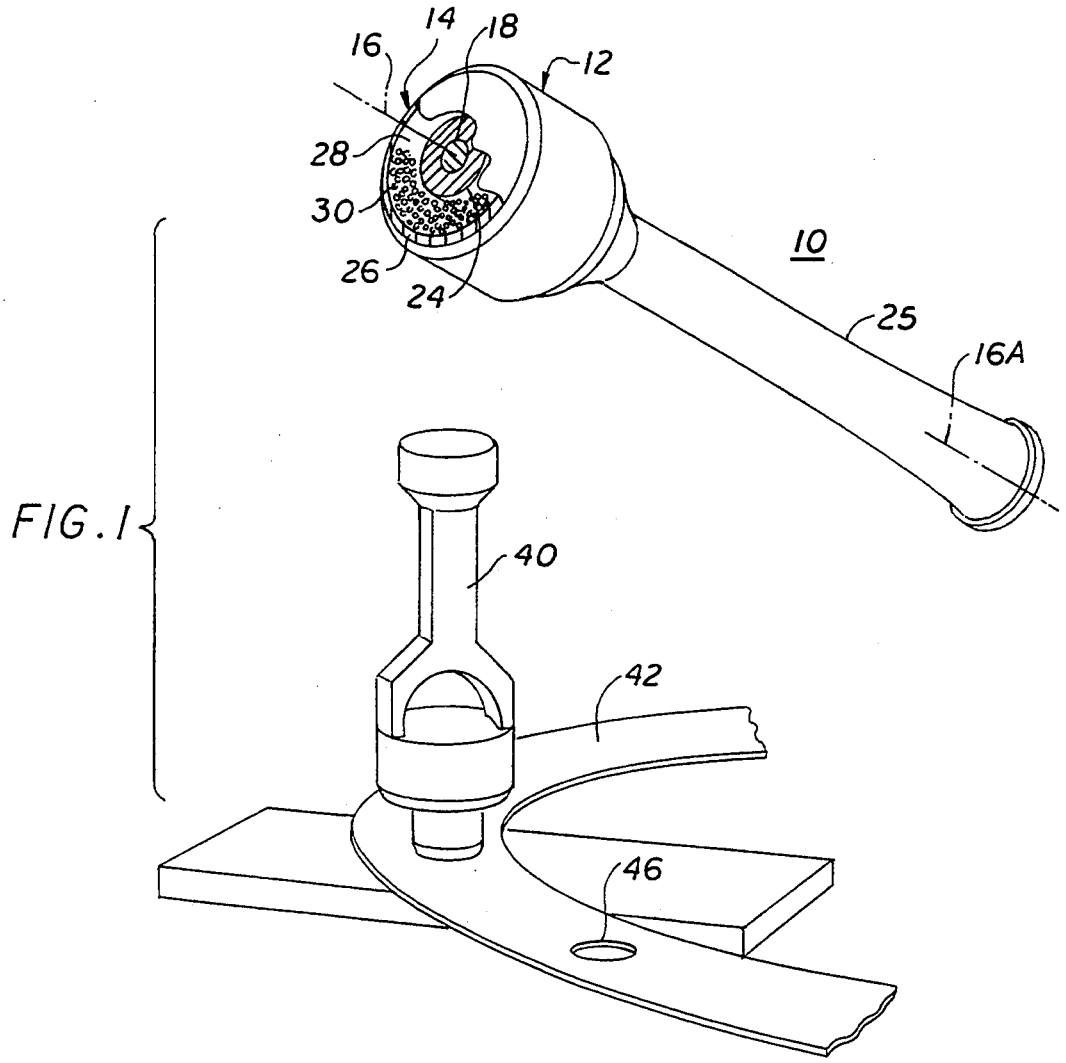
FIG. 1 a perspective view of a maul in accordance with an exemplary embodiment of the present invention illustrating striking a punch to form a gasket from a gasket material.

An exemplary embodiment of the present invention is illustrated in FIG. 1 as a maul assembly generally shown at 10, hereinafter referred to as the maul 10, striking a punch 40 to form a gasket (not shown) from a gasket material 42 leaving a cutout 46 of the gasket. The maul 10 includes a maul head 12 having an annular body 14 with an annular outer wall 26 concentric to an annular inner wall 24 and an annular chamber 28 within the body disposed between the two walls. The annular inner and outer walls 24 and 26 respectively and chamber 28 are circumferentially disposed about a head center axis 16 which is coincidental with a handle center axis 16A of a handle 25 attached to one end of the maul head 12. The chamber 28 is partially filled with a quantity of flowable inertia material, preferably round steel shot 30, and preferably in a range of about 50% to 75% of the chamber's volume with the steel shot 30. I have found that for a maul having a ratio of head diameter to handle diameter of about 2:1, that about 50% of the chamber's volume filled with the steel shot is a particularly advantageous amount. I have also found that as the head to handle diameter gets smaller it is advantageous to increase the percentage of the chamber's volume filled with the steel shot.

Figure 2:
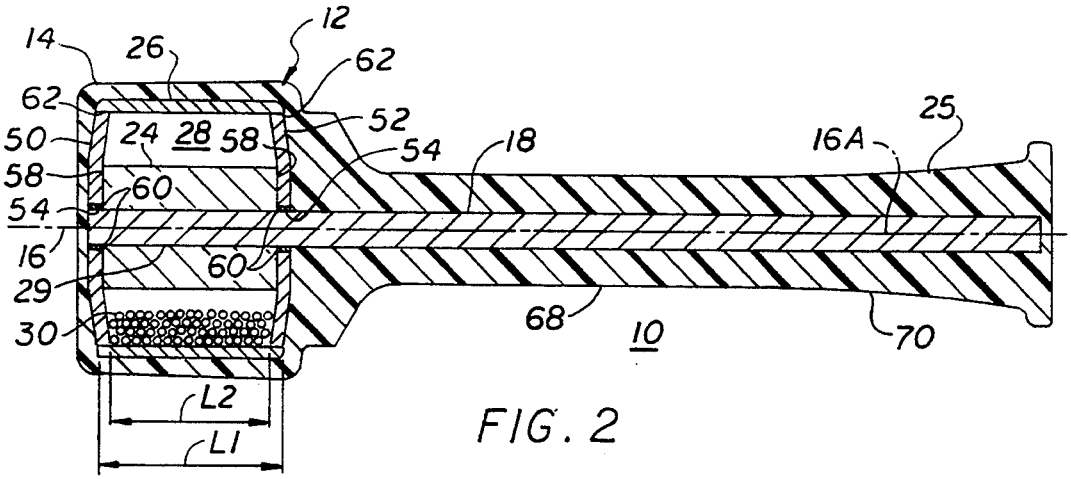
FIG. 2 a cross-sectional side view of the maul illustrated in FIG. 1.

Referring now to FIG. 2, the handle 25 has a cylindrical rod 18 symmetrical about the handle center axis 16A and is preferably solid and made of steel. The annular maul head 12 is circumferentially disposed about one end 29 of the rod 18. The annular outer wall 26 has a first length L1 and the annular inner wall 24 is in contact with and disposed about the rod 18 and has a second length L2 that is shorter than the first length L1. Front and rear chamber ends of the chamber 28 are formed by front and rear end walls 50 and 52 respectively which are disposed within and at opposite ends of the outer wall 26. The front and rear end walls 50 and 52 respectively have central circular holes 54 through which the rod 18 is disposed and the end walls abut opposite inner wall ends 58 of the inner wall 24.

A securing means to hold the assembly together and secure it is provided preferably in the form of a first set of welded seams 60 between the end walls 50 and 52 and the rod 18 and the inner wall 24 and a second set of interference fit seams 62 between the end walls 50 and 52 and the outer wall 26. The end walls 50 and 52 can be swaged or press fit into the ends of the outer wall 26 to form the second set of interference fit seams 62. An alternate securing means to hold the assembly together and secure it is provided preferably in the form of the first set of welded seams 60 between the end walls 50 and 52 and the rod 18 and the inner wall 24 and an alternate second set of welded seams 62 between the end walls 50 and 52 and the outer wall 26. Other types of securing means are contemplated such as interference fits between the end walls 50 and 52 and the rod 18 and the inner wall 24 and interference fits between the end walls 50 and 52 and the outer wall 26.

A molded plastic cover 68 surrounds the maul head 12 and a portion of the rod 18 extending from the head to help form the handle 25 attached to the head. The handle 25 preferably has a gradually widened handle end portion 70 which is opposite the maul head 12 and widens in the longitudinal direction away from the maul head 12. This provides an improved grip that helps prevent the maul from slipping out of the grip of the user.

Referring now to FIG. 1, during operation the maul 10 is raised and then brought down upon the punch 40 which causes the a portion of the quantity of flowable inertia material, preferably round steel shot 30, to flow around the annular inner wall 24 through the annular chamber 28 in a clockwise direction and the remaining quantity of flowable inertia material to flow around the annular inner wall 24 in a counter-clockwise direction. This reduces or eliminates moments about the head center axis 16 of the maul head 12 thereby tending to make the maul head more stable and prevent it from causing the punch 40 from tilting sideways. The present invention requires less hand and arm strength to be exerted for stabilizing the maul, as compared to mauls in the prior art, during the striking process. This helps prevent the need for additional hand and arm strength to be exerted by the user to stabilize the maul and thus allows the user to use more power to hit the punch and drive it with more ease and less hits through the material. Use of the present invention also reduces the user's apprehension and makes him more comfortable in exerting greater striking power thus allowing the user to safely maximize the amount power he uses to drive the punch through the material. The user is thus able to operate at a faster pace and with less strikes.

While the preferred embodiment of the invention has been described fully in order to explain its principles, it is understood that various modifications or alterations may be made to the preferred embodiment without departing from the scope of the invention as set forth in the appended claims.

I claim:

1. A maul head comprising:

an annular body having an annular chamber disposed between concentric annular outer and inner walls of said annular body wherein said chamber is partially filled with a quantity of flowable inertia material.

2. A maul head as claimed in claim 1 wherein said quantity is in a range of about 50% to 75% of said chamber's volume.

3. A maul head as claimed in claim 1 wherein said quantity is about 50% of said chamber's volume.

4. A maul head as claimed in claim 2 wherein said inertia material is steel shot.

5. A maul comprising:

a maul head having a longitudinally extending annular body with an annular chamber disposed between concentric annular outer and inner walls of said annular body, a handle secured to said annular body and extending longitudinally from an end of said annular body, and wherein said chamber is partially filled with a quantity of flowable inertia material.

6. A maul as claimed in claim 5 wherein said quantity is about 50% of said chamber's volume.

7. A maul as claimed in claim 6 wherein said inertia material is steel shot.

8. A maul as claimed in claim 6 wherein said longitudinally extending handle includes a longitudinally extending rod having a first rod end disposed through a center bore of said longitudinally extending annular body.

9. A maul as claimed in claim 8 wherein a first end portion of said handle which longitudinally extends from said annular body and said annular body are covered with a molded plastic cover.

10. A maul as claimed in claim 9 wherein said handle includes a second end portion of said handle which gradually widens in the longitudinal direction away from said maul head.

11. A maul comprising:

a longitudinally extending annular body assembly secured to a longitudinally extending handle, said annular body assembly having an annular outer wall radially spaced apart from and concentric to an annular inner wall, two annular end walls oppositely disposed at and in sealing engagement with opposite ends of said outer annular wall, said two annular end walls in sealing engagement with ends of said annular inner walls forming an annular chamber between said inner and outer annular walls and between said end walls, and said chamber is partially filled with a quantity of flowable inertia material.

12. A maul as claimed in claim 11 wherein said quantity is in a range of about 50% to 75% of said chamber's volume.

13. A maul head as claimed in claim 11 wherein said quantity is about 50% of said chamber's volume.

14. A maul as claimed in claim 12 wherein said longitudinally extending handle includes a longitudinally extending rod having a first rod end disposed through a center bore of said longitudinally extending annular body assembly.

15. A maul as claimed in claim 14 further comprising a securing means for sealing said chamber and attaching said rod to said annular body assembly;

said securing means comprises first and second annular joints between said end walls and said rod and third and fourth annular joints between said end walls and said outer wall, and said end walls abut opposite ends of said inner wall.

16. A maul as claimed in claim 15 wherein said first annular joints are welded seams and said second annular joints are interference fit seams.

17. A maul as claimed in claim 15 wherein said first annular joints are welded seams and said second annular joints are press fit seams.

18. A maul as claimed in claim 16 wherein a first end portion of said handle which longitudinally extends from said annular body and said annular body are covered with a molded plastic cover.

19. A maul as claimed in claim 18 wherein said handle includes a second end portion of said handle which gradually widens in the longitudinal direction away from said maul head.

* * * * *